US005331703A

United States Patent [19]

Mejia et al.

[11] Patent Number: 5,331,703

[45] Date of Patent: Jul. 26, 1994

[54] POWER DRIVEN FLOOR AND WALL SCRUBBER

[76] Inventors: Rafael Mejia; Rafael Mercado, both of 53 Calistemon St., Guaynabo, P.R. 00966; George Spector, 233 Broadway Rm 702, New York, N.Y. 10279

[21] Appl. No.: 48,300

[22] Filed: Apr. 19, 1993

[51] Int. Cl.[5] ..... A47L 11/12

[52] U.S. Cl. ..... 15/98; 15/52.2

[58] Field of Search ..... 15/50.2, 52.2, 98, 374, 15/380

[56] References Cited

FOREIGN PATENT DOCUMENTS 854407 10/1970 Canada ..... 15/98

2038057 2/1972 Fed. Rep. of Germany ..... 15/50.2

*Primary Examiner*—Edward L. Roberts

[57] ABSTRACT

A power driven floor and baseboard scrubber is provided having reciprocating plates with scrubbing pads thereon arranged to clean an area at an intersection of the floor and the baseboard, on a stair step and its riser. A handle is provided for operational purposes and wheels for transportation.

8 Claims, 3 Drawing Sheets

POWER DRIVEN FLOOR AND WALL SCRUBBER

BACKGROUND OF THE INVENTION

The instant invention relates generally to polishing, sanding and cleaning devices and more specifically it relates to a power driven floor and baseboard scrubber, which provides reciprocating plates with scrubbing pads to clean the floor and baseboard, the step and riser on stairs.

There are available various conventional polishing, sanding and cleaning devices which do not provide the novel improvements of the invention here in disclosed.

SUMMARY OF THE INVENTION

A primary object of the present invention is to provide a power driven floor and baseboard scrubber that will overcome the shortcomings of the prior art devices.

Another object is to provide a power driven floor and baseboard scrubber having reciprocating plates with scrubbing pads there on arranged to clean an area at an intersection of the floor and the baseboard.

An additional object is to provide a power driven floor and baseboard scrubber having a handle and wheels there on, so that the scrubber can be transported along the floor.

A further object is to provide a power driven floor and baseboard scrubber that is simple and easy to use.

A still further object is to provide a power driven floor and baseboard scrubber that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
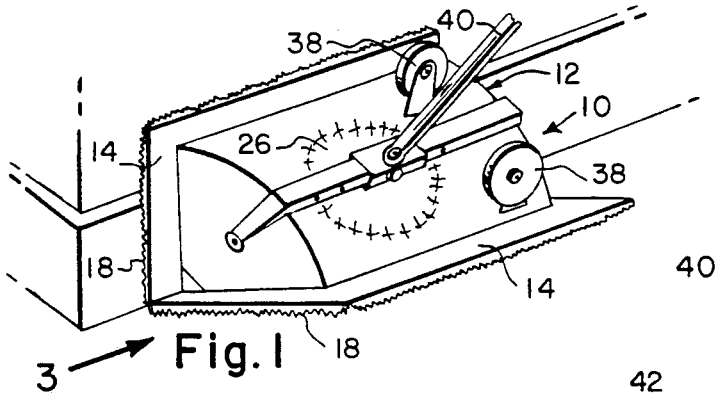
FIG. 1 is a diagrammatic perspective view of a first embodiment of the instant invention in a working position.

Turning now descriptively to the drawings, in which similar reference characters denote similar elements throughout the several views, FIGS. 1 through 6 illustrate a first embodiment of a power driven floor and baseboard scrubber 10 which consists of a triangular frame assembly 12 and a pair of flat elongated plates 14. An apparatus 16 is for mounting the plates 14 for longitudinal movement relative to the triangular frame assembly 12 with an angle between the plates 14 of substantially ninety degrees. A pair of scrubbing pads 18 are each secured to an external surface of one of the plates 14. A device 20 is for reciprocating in alternate longitudinal directions the plates 14 relative to the triangular frame assembly 12, so that the pads 18 will clean an area at an intersection of the floor and the baseboard, when in a working position (see FIG. 7).

Figure 3:
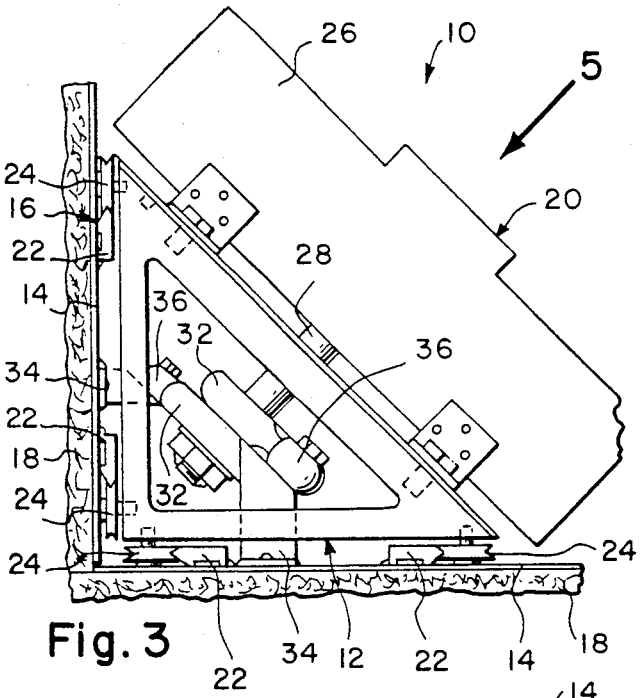
FIG. 3 is a side view taken in direction of arrow 3 in FIG. 1, with the handle and wheels removed.
Figure 6:
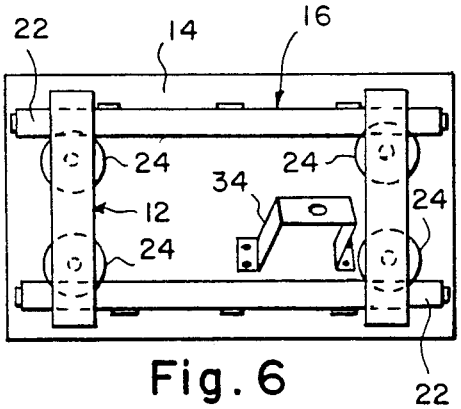
FIG. 6 is a rear view of the vertical and horizontal related cooperative components thereon.
Figure 7:
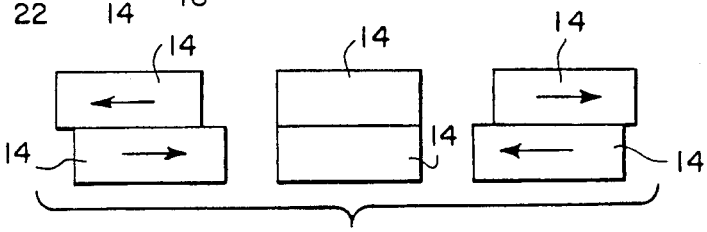
FIG. 7 is a diagrammatic view showing the reciprocating slide movements of the plates.
Figure 4:
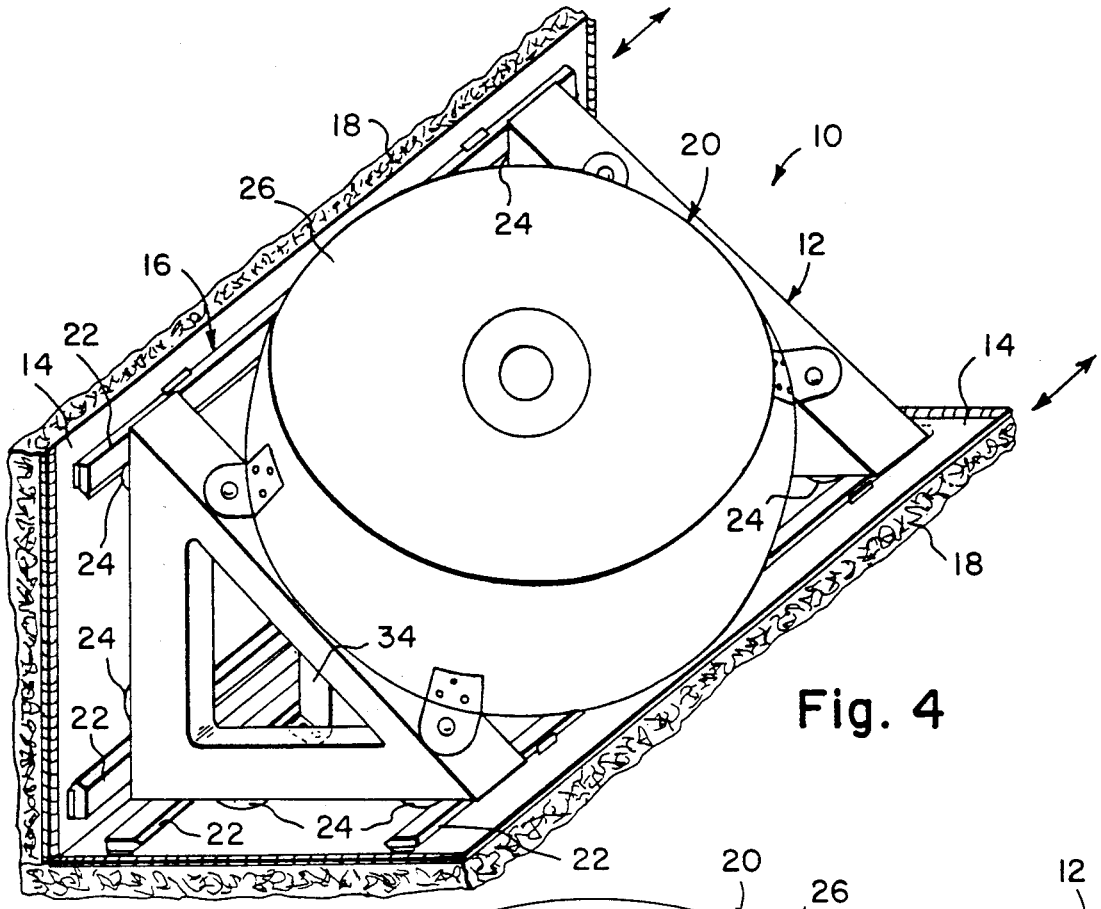
FIG. 4 is a perspective view of the first embodiment with the handle and wheels removed.

The mounting apparatus 16, as shown in FIGS. 3, 4 and 6 includes four V-track bars 22, in which two are secured to a rear surface of each plate 14 in spaced apart facing parallel relationships. Eight V-guide bearing rollers 24 are rotatably mounted to the triangular frame assembly 12 in spaced apart relationships, so that two V-guide bearing rollers 24 will engage with each V-track bar 22.

Figure 5:
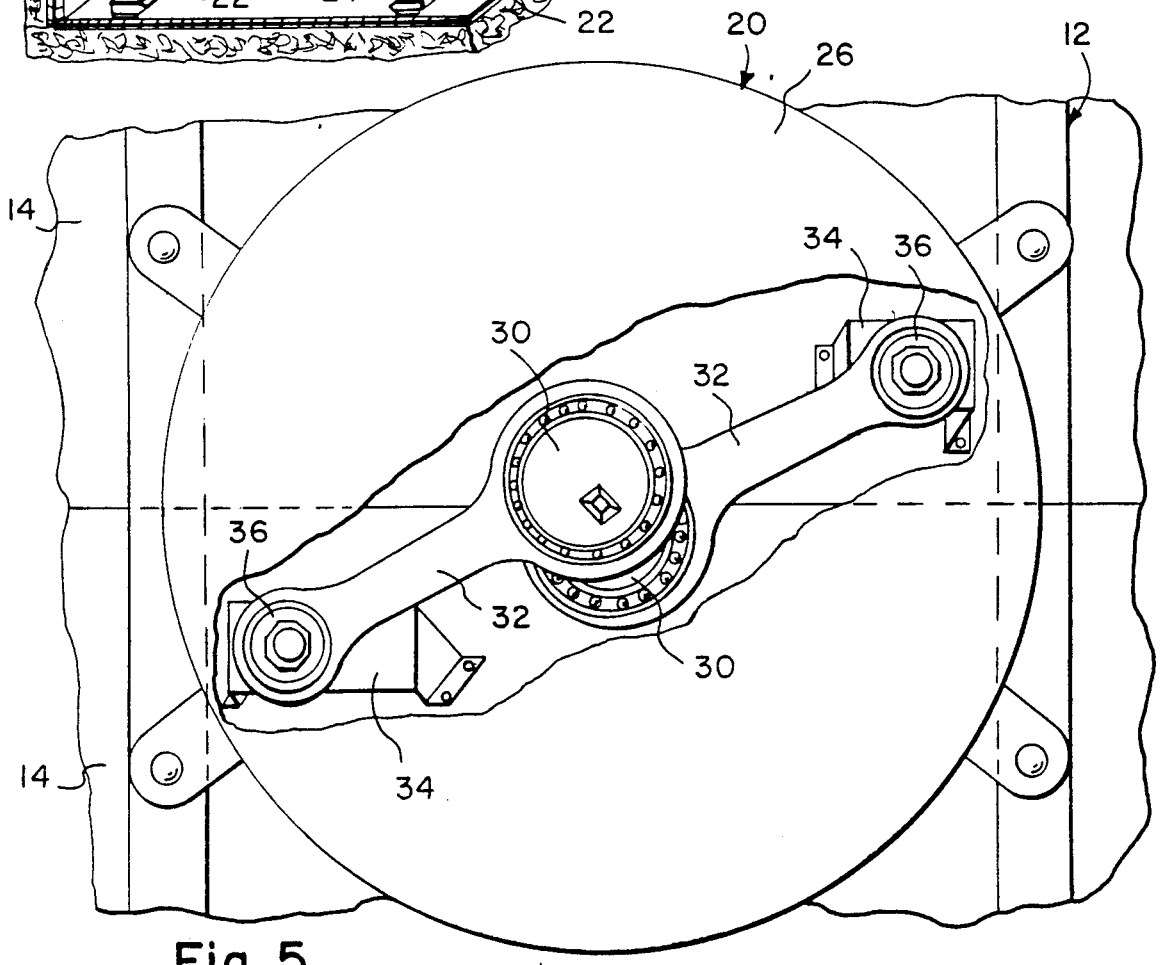
FIG. 5 is an enlarged rear view taken in direction of arrow 5 in FIG. 3, with parts broken away showing the reciprocating assembly therein.
Figure 9:
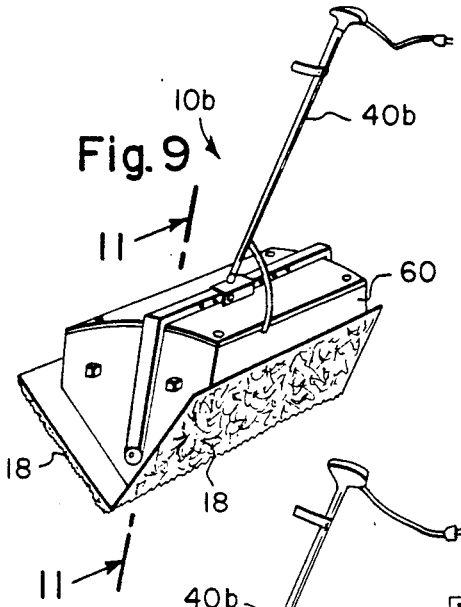
FIG. 9 is a diagrammatic perspective view of a third embodiment of the instant invention.
Figure 11:
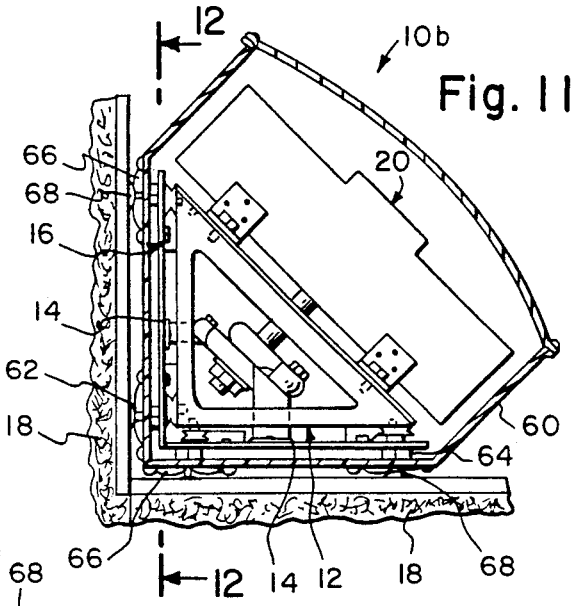
FIG. 11 is a cross sectional view taken along line 11—11 in FIG. 9.
Figure 10:
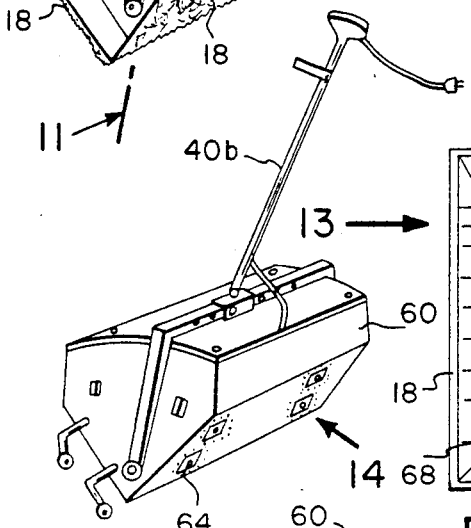
FIG. 10 is a diagrammatic perspective view similar to FIG. 9, with the scrubbing pads removed therefrom.
Figure 12:
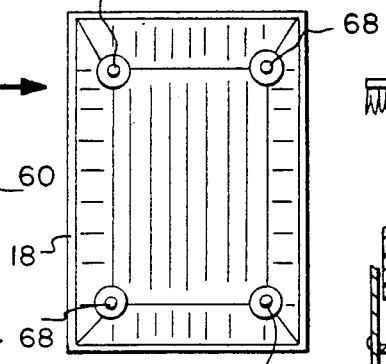
FIG. 12 is a rear view taken along line 12—12 in FIG. 11 of one of the scrubbing pads.
Figure 13:
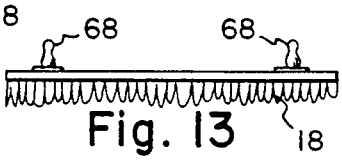
FIG. 13 is a side view of the scrubbing pad taken in direction of arrow 13 in FIG. 12.
Figure 15:
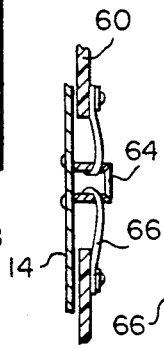
FIG. 15 is a cross sectional view taken along line 15—15 in FIG. 14.
Figure 14:
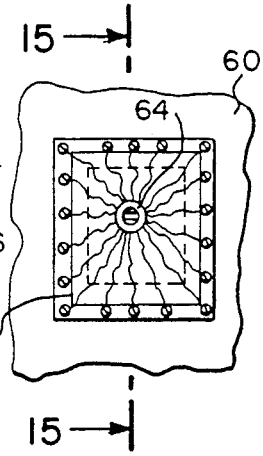
FIG. 14 is an enlarged front view taken in direction of arrow 14 in FIG. 10 showing one of the flexible seals in greater detail.

The reciprocating device 20, as shown in FIGS. 3, 4 and 5 contains a motor 26 mounted to the triangular frame assembly 12 opposite from the plates 14. A drive shaft 28 extends from the motor 26. A pair of eccentric drive cam units 30 are attached to the drive shaft 28. A pair of reciprocal connecting rods 32 are driven by the eccentric drive cam units 30 and extends outwardly form the drive shaft 28 in opposed directions. A pair of angled C-brackets 34 are provided with each connected to the rear surface of each plate 14. A pair of spherical bearing units 36 are each mounted onto one of the angled C-brackets 34 and a distal end of one of the connecting rods 32. Rotation of the drive shaft 28 of the motor 26 will cause the connecting rods 32 to reciprocate the plates 14.

Figure 2:
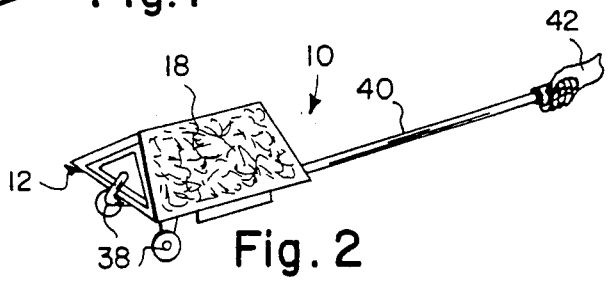
FIG. 2 is a diagrammatic perspective view of the first embodiment upside down in a transporting position.

The power driven floor and baseboard scrubber 10 in FIGS. 1 and 2 includes a pair of wheels 38 mounted to the triangular frame assembly 12 opposite from the plates 14. A handle 40 is mounted to the triangular frame assembly 12 opposite from the plates 14. When the scrubber 10 is inverted into a transporting position, as shown in FIG. 2. a hand 42 of a person can grip the handle 40 to pull the scrubber 10 along the floor.

Figure 8:
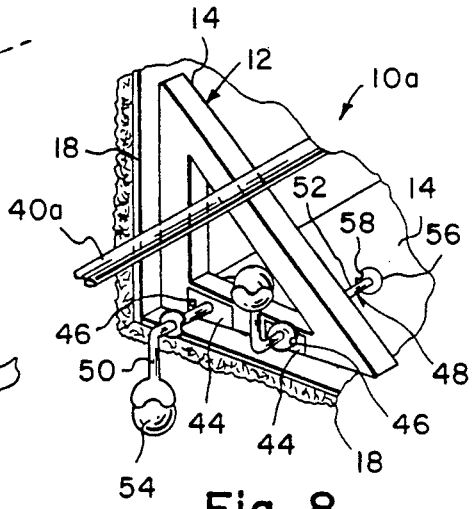
FIG. 8 is a diagrammatic perspective view of a second embodiment of the instant invention showing adjustable casters on the triangular frame assembly, so that the instant invention can be placed in a transporting position without having to be turned upside down.

FIG. 8 shows a second embodiment power driven floor and baseboard scrubber 10*a*, which contains a pair of permanent magnets 44 located within one side of the triangular frame assembly 12 adjacent one of the plates 14. A locking pin 46 extends through one side of each of the permanent magnets 44. A pair of L-shaped shafts 48 are provided with each having a short leg and a long leg 52, which slides and rotates through one of the permanent magnets 44. A caster 54 is mounted to a distal end of each short leg 50. Four washers 56 are provided with each having a side detent 58. Two of the washers 56 are affixed in a spaced apart relationship onto each long leg 52 on opposite sides of one permanent magnet 44 with the side detents 58 in opposite positions. Each caster 54 can be positioned in a retained up position when the scrubber 10*a* is in the working position and can be positioned in a retained down position when the scrubber 10*a* is in the transporting position. A handle 40*a* is mounted to the triangular frame assembly 12 opposite from the plates 14. When the scrubber 10*a* is in its transporting position, a hand of a person can grip the handle 40*a* to pull said scrubber 10*a* along the floor.

FIGS. 9 through 17 show a third embodiment power driven floor and baseboard scrubber 10*b* that further includes a housing 60 for enclosing the triangular frame assembly 12, the mounting apparatus 16 and the reciprocating device 20. A structure 62 is for removably securing each scrubbing pad 18 to each plate 14 through the housing 60. The removably securing structure 62 for each scrubbing pad 18 includes a plurality of female sockets 64 mounted to a front surface of the plate 14. A plurality of flexible seals 66 are mounted into the housing 60 in front of the female sockets 64. A plurality of male locking pins 68 are mounted to a rear surface of the scrubbing pad 18. so that the male locking pins 68 can be inserted through the flexible seals 66 and into the female sockets 64.

FIGS. 1,2.8.9 and 10 show a pivotable handle 40,40*a* or 40*b* used to transport and operate the scrubbers.

Figure 18:
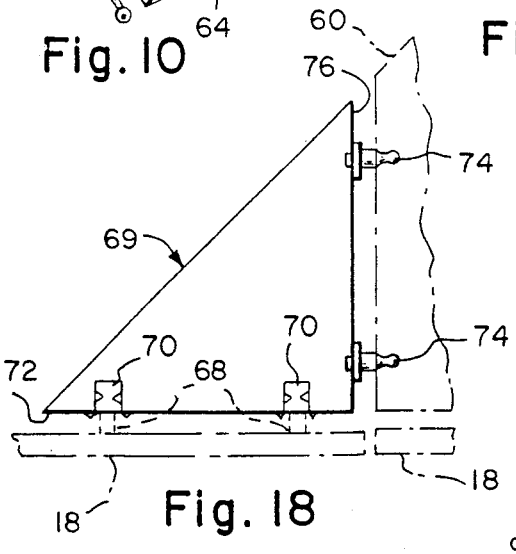
FIG. 18 is a side view of a triangular shaped base attachment.
Figure 17:
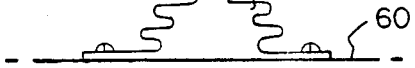
FIG. 17 is a side view taken in direction of arrow 17 in FIG. 16.
Figure 16:
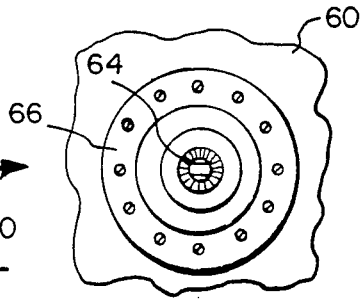
FIG. 16 is an enlarged front view similar to FIG. 14 showing another type of flexible seal.

A triangular shaped base attachment 69 is shown in FIG. 18. A plurality of female sockets 70 mounted into a first side 72 of the base attachment 69. A plurality of male locking pins 74 are mounted into a second side 76 of the base attachment 69. The male locking pins 74 can be inserted through the flexible seals 66 on a vertical portion of the housing 60 and into the female sockets 64 in a vertical positioned plate 14. The male locking pins 68 on one scrubbing pad 18 can be inserted into the female sockets 70 in the base attachment 69. The two scrubbing pads 18 are now horizontally positioned next to each other to be used only on the floor.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A power driven floor and baseboard scrubber which comprises:

a) a triangular frame assembly;

b) a pair of flat elongated plates;

c) means for mounting said plates on said frame for relative longitudinal movement with an angle formed between said plates of substantially ninety degrees;

d) a pair of scrubbing pads, each secured to an external surface of one of said plates; and e) means for reciprocating in alternate longitudinal directions said plates relative to said triangular frame assembly, so that said pads will clean an area at an intersection of the floor and the baseboard, when in a working position.

2. A power driven floor and baseboard scrubber as recited in claim 1, wherein said mounting means includes:

a) four V-track bars in which two are secured to a rear surface of each said plate in spaced apart facing parallel relationships; and b) eight V-guide bearing rollers rotatably mounted to said triangular frame assembly in spaced apart relationships, so that two said V-guide bearing rollers will engage with each said V-track bar.

3. A power driven floor and baseboard scrubber as recited in claim 2, wherein said reciprocating means includes:

a) a motor mounted to said triangular frame assembly opposite from said plates;

b) a drive shaft extending from said motor;

c) a pair of eccentric drive cam units attached to said drive shaft;

d) a pair of reciprocal connecting rods driven by said eccentric drive cam units and extending outwardly from said drive shaft in opposed directions;

e) a pair of angled C-brackets, each connected to the rear surface of each said plate; and f) a pair of spherical bearing units, each mounted onto one of said angled C-brackets and a distal end of one of said connecting rods, whereby rotation of said drive shaft of said motor will cause said connecting rods to reciprocate said plates.

4. A power driven floor and baseboard scrubber as recited in claim 3, further including:

a) a pair of wheels mounted to said triangular frame assembly opposite from said plates; and b) a handle mounted to said triangular frame assembly opposite from said plates, so that when said scrubber is inverted into a transporting position a hand of a person can grip said handle to pull said scrubber along the floor.

5. A power driven floor and baseboard scrubber as recited in claim 3, further including:

a) a pair of permanent magnets located within one side of said triangular frame assembly adjacent one of said plates;

b) two locking pins, each extending through one side of one of said permanent magnets;

c) a pair of L-shaped shafts, each having a short leg and a long leg which slides and rotates through one of said permanent magnets;

d) a pair of casters, each mounted to a distal end of said short leg;

e) four washers, each having a side detente in which two of said washers are affixed in a apaced apart relationship onto each said long leg on opposite sides of one said permanent magnet with said side detentes in opposite positions, so that each said caster can be positioned in a retained up position when said scrubber is in the working position and can be positioned in a retained down position when said scrubber is in the transporting position; and f) a handle mounted to said triangular frame assembly opposite from said plates, for operational purposes and when said scrubber is in its transporting position a hand of a person can grip said handle to pull said scrubber along the floor.

6. A power driven floor and baseboard scrubber as recited in claim 3, further including:

a) a housing for enclosing said triangular frame assembly, said mounting means and said reciprocating means; and b) means for removably securing each said scrubbing pad to each said plate through said housing.

7. A power driven floor and baseboard scrubber as recited in claim 6, wherein said removably securing means for each said scrubbing pad includes:

a) a plurality of female sockets mounted to a front surface of said plate;

b) a plurality of flexible seals mounted into said housing in front of said female sockets; and c) a plurality of male locking pins mounted to a rear surface of said scrubbing pad, so that said male locking pins can be inserted through said flexible seals and into said female sockets.

8. A power driven floor and baseboard scrubber as recited in claim 7, further including:

a) a triangular shaped base attachment;

b) a plurality of female sockets mounted into a first side of said base attachment;

c) a plurality of male locking pins mounted onto a second side of said base attachment, so that said male locking pins can be inserted through said flexible seals on a vertical portion of said housing and into said female sockets in a vertical positioned plate, while said male locking pins on one said scrubbing pad can be inserted into said female sockets in said base attachment, whereby said two scrubbing pads are now horizontally positioned next to each other to be used only on the floor.

* * * * *